US009044983B2

(12) United States Patent
Takebayashi et al.

(10) Patent No.: US 9,044,983 B2
(45) Date of Patent: Jun. 2, 2015

(54) LIQUID JETTING APPARATUS

(75) Inventors: Mizuyo Takebayashi, Nagoya (JP); Shohei Koide, Nagoya (JP); Yusuke Suzuki, Nishio (JP); Hiromitsu Mizutani, Ichinomiya (JP); Atsushi Ito, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 251 days.

(21) Appl. No.: 13/558,489

(22) Filed: Jul. 26, 2012

(65) Prior Publication Data

US 2013/0076818 A1 Mar. 28, 2013

(30) Foreign Application Priority Data

Sep. 26, 2011 (JP) ..... 2011-209056

(51) Int. Cl.
*B41J 29/38* (2006.01)
*B41J 2/155* (2006.01)

(52) U.S. Cl.
CPC *B41J 29/38* (2013.01); *B41J 2/155* (2013.01); *B41J 2202/20* (2013.01)

(58) Field of Classification Search
CPC ..... B41J 2/155; B41J 29/38; B41J 2202/20
USPC ..... 347/12, 40, 49, 14, 42, 37; 356/28
See application file for complete search history.

(56) References Cited

U.S. PATENT DOCUMENTS

| | | | | |
|---|---|---|---|---|
| 8,172,363 | B2 * | 5/2012 | Mills et al. | 347/42 |
| 8,702,203 | B2 * | 4/2014 | Mizutani et al. | 347/37 |
| 2003/0071984 | A1 * | 4/2003 | Teramae et al. | 356/28 |
| 2004/0201641 | A1 * | 10/2004 | Brugue et al. | 347/40 |
| 2008/0211872 | A1 * | 9/2008 | Hoisington et al. | 347/49 |
| 2010/0225694 | A1 * | 9/2010 | Suzuki | 347/14 |

FOREIGN PATENT DOCUMENTS

| | | |
|---|---|---|
| JP | H11-254659 | 9/1999 |
| JP | 2010-000643 | 1/2010 |
| JP | 2010-162801 | 7/2010 |
| JP | 2010/201790 | 9/2010 |

OTHER PUBLICATIONS

Notice of Reasons for Rejection for Japanese Patent Application No. 2011-209056 dated Jan. 20, 2015.

* cited by examiner

*Primary Examiner* — Julian Huffman
*Assistant Examiner* — Carlos A Martinez
(74) *Attorney, Agent, or Firm* — Frommer Lawrence & Haug LLP

(57) ABSTRACT

A liquid jetting apparatus includes: a head unit including a liquid jetting head, a regulating member arranged to sandwich the head unit from a nozzle array direction, a restriction mechanism configured to restrict the head unit from displacement in an orthogonal direction perpendicular to the nozzle array direction, and a landing position correction mechanism configured to correct position of landing the liquid jetted from the plurality of nozzles onto the medium in the orthogonal direction. The restriction mechanism restricts a portion of the head unit inside of outmost nozzle arrays in the orthogonal direction.

16 Claims, 11 Drawing Sheets

LIQUID JETTING APPARATUS

CROSS REFERENCE TO RELATED APPLICATION

The present application claims priority from Japanese Patent Application No. 2011-209056 filed on Sep. 26, 2011, the disclosures of which are incorporated herein by reference in their entirety.

BACKGROUND OF THE INVENTION

1. Field of the Invention

The present invention relates to liquid jetting apparatuses for jetting liquids from nozzles.

2. Description of the Related Art

Conventionally, there have been known head units each having a plurality of heads as liquid jetting heads while a plurality of nozzles are formed in each of the heads. Here, the plurality of nozzles are aligned along one direction to form respective nozzle arrays. The plurality of heads are arranged on a base plate as a holding member. Further, the base plate is sandwiched from the nozzle array direction by two frame members as regulating members. Then, by virtue of this, when the base plate is expanding due to temperature rise, the frame members constrain the same from extension in the nozzle array direction to prevent the nozzles from deviation between the plurality of heads in the nozzle array direction.

At this time, the base plate is not constrained from extension in the direction perpendicular to the nozzle array direction, thereby causing the nozzles to deviate in that direction between the heads. However, by adjusting the timing of jetting inks from each nozzle, the position of landing the inks on a recording sheet is corrected in the same direction.

SUMMARY OF THE INVENTION

According to a knowledge of the present inventors, if, by assumption, the nozzles deviate in the nozzle array direction between the plurality of heads, then even though the jet timing of the inks from the nozzles is corrected, etc., it is not possible to correct the landing position. Here in the head unit described above, the base plate tends to expand uniformly when temperature rises. At the time, however, the portions of different base plates without displacement during the expansion vary from each other. Therefore, the portion sandwiched tightly by the regulating members varies with each head unit. Accordingly, in order to accurately correct the landing position, it is necessary to change the adjustment amount of the jet timing according to each head unit. Nevertheless, it is difficult to accurately find the adjustment amount of the jet timing when the base plate expands for each head unit. Hence, there is a risk of failing to accurately correct the landing position.

Accordingly, an object of the present invention is to provide a liquid jetting apparatus capable of correctly apprehending the amount of displacement of nozzles when the head unit has expanded or contracted due to temperature change, and thereby accurately correcting the position of landing a liquid jetted from the nozzles onto a jet object.

According to an aspect of the present invention, there is provided a liquid jetting apparatus which jets a liquid onto a medium, including:

a head unit including a liquid jetting head in which a plurality of nozzles are formed, the plurality of nozzles being aligned in a nozzle array direction to form a plurality of nozzle arrays along an orthogonal direction perpendicular to the nozzle array direction;

a regulating member arranged to sandwich the head unit from the nozzle array direction so that the regulating member regulates the head unit from expansion and contraction due to temperature change along the nozzle array direction;

a restriction mechanism configured to restrict the head unit from displacement in the orthogonal direction perpendicular to the nozzle array direction under a condition that the head unit is expanding or contracting due to temperature change; and a landing position correction mechanism configured to correct position of landing the liquid jetted from the plurality of nozzles onto the medium in the orthogonal direction under a condition that the head unit is expanding or contracting due to temperature change, wherein the restriction mechanism restricts a portion of the head unit inside of outmost nozzle arrays in the orthogonal direction.

According to the aspect of the present invention, when the head unit is expanding or contracting due to temperature change, because no displacement in the orthogonal direction occurs in the reference portion of the head unit restricted by the restriction mechanism, each portion of the head unit is displaced by the amount according to the temperature of the head unit and the distance from the reference portion. Therefore, it is possible to correctly apprehend the amount of displacement of each nozzle when the head unit has expanded or contracted due to temperature change. As a result, it is possible to accurately correct the landing position in the orthogonal direction perpendicular to the nozzle array direction. Further, if the restriction mechanism restricts the head unit by sandwiching the end portions thereof, then the reference portion corresponds to the portion of the head unit between the portions in contact with the restriction mechanism.

Further, the portion of the head unit inside of the outmost nozzle arrays in the orthogonal direction perpendicular to the nozzle array direction fits into the reference portion with no displacement in the orthogonal direction due to expansion and contraction of the head unit. Therefore, the distance between the reference position and the farthest nozzle becomes closer than in the case of providing the reference portion outside of the outmost nozzle columns. Therefore, when the head unit has expanded or contracted, the displacement of the nozzles away from the reference position becomes smaller and, as will be described hereinafter, it is sufficient for the landing position correction mechanism to apply a small correction amount to the landing position. By virtue of this, it is possible to accurately correct the landing position.

DESCRIPTION OF THE PREFERRED EMBODIMENT

Hereinbelow, a preferred embodiment of the present teaching will be explained.

Figure 1:
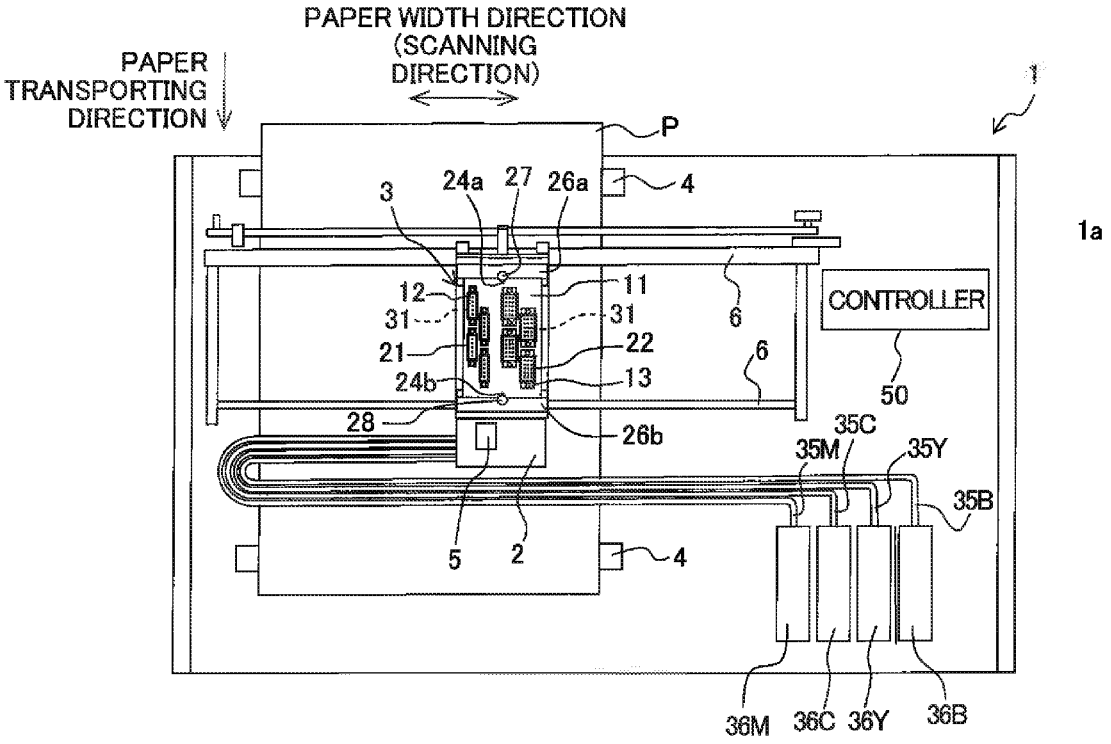
FIG. 1 is a schematic configuration diagram of a printer as an example of the liquid jet apparatus in accordance with an embodiment of the present teaching.

As shown in FIG. 1, as a liquid jetting apparatus in accordance with the present embodiment, a printer 1 includes a carriage 2, a head unit 3, paper transporting rollers 4, a temperature sensor 5, and the like. Further, operations of the printer 1 are controlled by a controller 50.

The carriage 2 reciprocates along two guide rails 6 extending in a scanning direction parallel to a paper width direction. The head unit 3 is installed on the carriage 2 to jet inks from a plurality of nozzles 31 formed in its lower surface. The paper transporting rollers 4 transport a recording paper P in a paper feeding direction perpendicular to the scanning direction. The temperature sensor 5 is provided on the carriage 2 to detect the temperature of the head unit 3. In particular, the temperature sensor 5 detects the temperature of an aftermentioned head holding plate 11. Alternatively, it may as well detect a temperature changing with the temperature of the head holding plate 11. For example, the temperature sensor 5 may as well detect an environmental temperature in the vicinity of the head holding plate 11. That is, the temperature sensor 5 detects the temperature of the head unit 3 directly or indirectly.

Then, the printer 1 carries out printing on the recording paper P by jetting inks from the plurality of nozzles 31 of the head unit 3 reciprocating along with the carriage 2 in the scanning direction, to the recording paper P transported by the paper transporting rollers 4 in the paper feeding direction.

Next, the head unit 3 will be explained in detail. As shown in FIGS. 1 to 3A and 3B, the head unit 3 includes the head holding plate 11 as a holding member, four black heads 12 as the heads for printing at low image quality, and four color heads 13 as the heads for printing at high image quality. Further, in the present embodiment, the four black heads 12 and the four color heads 13 correspond to a liquid jetting head in accordance with the present teaching.

The head holding plate 11 is an approximately rectangular plate-like member made of a ceramic material or the like and is arranged so that its longitudinal direction is substantially parallel to the paper feeding direction. Further, in the head holding plate 11, four through holes 21 and four through holes 22 are formed to align in a zigzag pattern along the paper feeding direction, respectively, on the left side and on the right side with respect to FIG. 2. Further, at both ends of the head holding plate 11 in the longitudinal direction, notches 24*a* and 24*b* are formed in the approximately central portion in the paper width direction, respectively. The more inside along the paper feeding direction, the narrower the notches 24*a* and 24*b* become along the scanning direction.

Further, the head holding plate 11 is sandwiched by two regulating members 26*a* and 26*b* fixed on the carriage 2 from the paper feeding direction, and supported from below at the same time. The regulating members 26*a* and 26*b* are made of a material with a linear expansion coefficient lower than that of the head holding plate 11, and extend over the entire length of the head holding plate 11 along the scanning direction.

Figure 2:
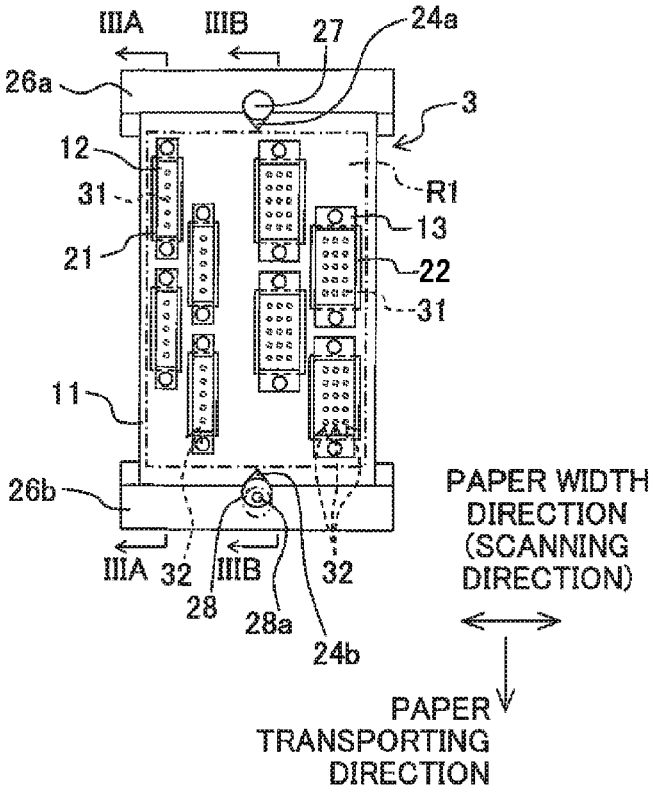
FIG. 2 is a plan view of a head unit of the printer of FIG. 1.
Figure 3A:
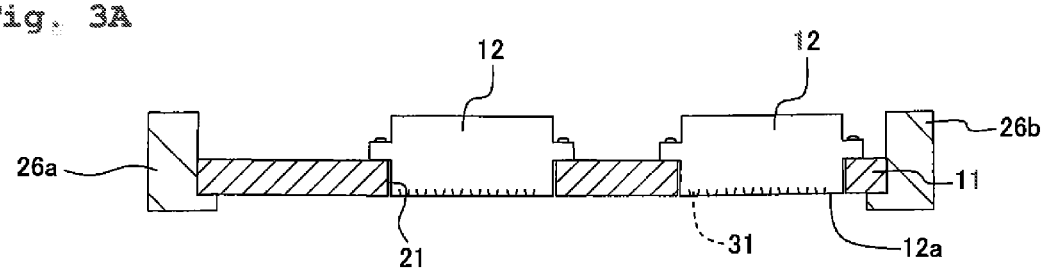
FIG. 3A is a cross-sectional view taken along the line IIIA-IIIA of FIG. 2.
Figure 3B:
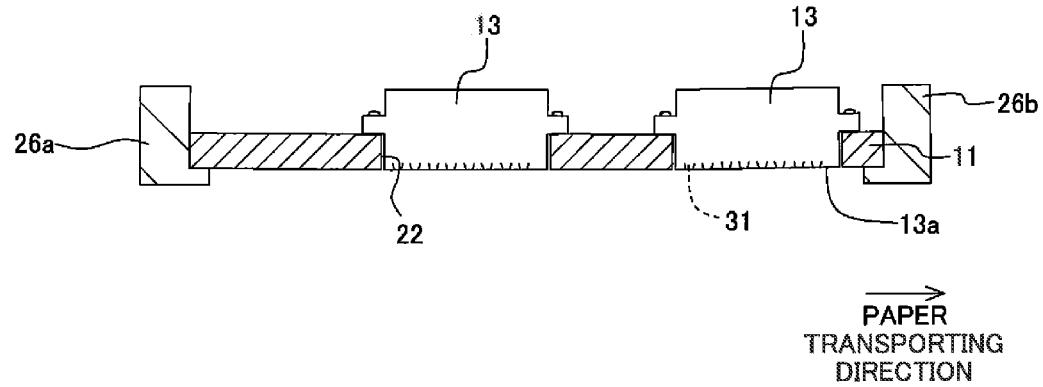
FIG. 3B is a cross-sectional view taken along the line IIIB-IIIB of FIG. 2.

Further, a positioning pin 27 of an approximately cylindrical shape is provided in the approximately central portion of the regulating member 26*a* in the scanning direction. The positioning pin 27 is adapted in or engages the notch 24*a*. An eccentric cam 28 of an approximately cylindrical shape is provided in the approximately central portion of the regulating member 26*b* in the scanning direction, and supported to be rotatable about a shaft 28*a* extending in a vertical direction perpendicular to the paper plane of FIG. 1. As shown in FIG. 2, the eccentric cam 28 engages the notch 24*b*.

Then, with the positioning pin 27 and the eccentric cam 28 in respective engagement with the notches 24*a* and 24*b*, the head holding plate 11 is sandwiched by the positioning pin 27 and the eccentric cam 28 on the portion positioned between the notch 24*a* and the notch 24*b* in the head unit 1. By virtue of this, the portion of the head holding plate 11 positioned between the two notches 24*a* and 24*b* is constrained from displacement. Here, the portion of the head holding plate 11 positioned between the two notches 24*a* and 24*b* is restrained or restricted from extension not only in the paper feeding direction but also in the scanning direction. In this manner, the portion of the head holding plate 11 positioned between the two notches 24*a* and 24*b* is constrained from displacement in both the paper feeding direction and the scanning direction. Thus, in the present application, this portion is referred to as the reference portion. Further, in the embodiment, the positioning pin 27 and the eccentric cam 28 correspond to a pair of sandwiching members in accordance with the present teaching, and the regulating members 26*a* and 26*b* provided with the former correspond to a fixation portion in accordance with the present teaching.

Further, by rotation about the shaft 28*a*, the eccentric cam 28 is movable between the position engaging the notch 24*b* as shown in FIG. 2 with a solid line, and the position outside of the notch 24*b* as shown in FIG. 2 with a chain double-dashed line.

When fitting the head holding plate 11 to the regulating members 26*a* and 26*b*, with the eccentric cam 28 being positioned outside of the notch 24*b*, the head unit 3 is placed between the two regulating members 26*a* and 26*b*, and then the eccentric cam 28 is rotated approximately 180 degrees while letting the positioning pin 27 engage the notch 24*a*. Accordingly, the positioning pin 27 and the eccentric cam 28 engage the notches 24*a* and 24*b* respectively, while the distance from the positioning pin 27 (to the eccentric cam 28) becomes shorter. By virtue of this, the reference portion of the head holding plate 11 positioned between the two notches 24*a* and 24*b* is tightly sandwiched. Therefore, the reference portion of the head holding plate 11 is constrained from displacement not only in the paper feeding direction as a matter of course, but in the scanning direction as well.

A plurality of nozzles 31 are formed in each of nozzle surfaces 12*a* which are the respective lower surfaces of the four black heads 12. Being aligned in the paper feeding direction parallel to the nozzle column direction, the plurality of these nozzles 31 form a nozzle array 32 as the nozzle column for printing at low image quality. Then, the four black heads 12 of such a configuration are aligned in a zigzag pattern along the paper feed direction such that the nozzle surfaces 12*a* are exposed through the four through holes 21.

Further, the black heads 12 are connected to a black cartridge 36B filled with a black ink through a tube 35B. By virtue of this, the black ink is supplied from the black cartridge 36B to the black heads 12, and jetted from the nozzles 31 of the black heads 12. Here, the black heads 12 include not only the plurality of nozzles 31 but also, for example, a plurality of unshown pressure chambers in respective communication with the nozzles 31, an unshown actuator for applying a pressure to the black ink in the pressure chambers, and the like. By applying the pressure to the ink in the pressure chambers, the black ink is jetted through the nozzles 31 by the actuator.

A plurality of other nozzles 31 are formed in each of nozzle surfaces 13*a* which are the respective lower surfaces of the four color heads 13. Being aligned in the paper feeding direction, the plurality of these nozzles 31 form three other nozzle arrays 32 as the nozzle arrays for printing at high image quality. Then, the four color heads 13 of such a configuration are aligned in a zigzag pattern along the paper feed direction such that the nozzle surfaces 13*a* are exposed through the four through holes 22.

Further, the color heads 13 are connected to three color cartridges 36Y, 36C and 36M filled respectively with color inks of yellow, cyan and magenta through three tubes 35Y, 35C and 35M. By virtue of this, the three color inks are supplied from the three color cartridges 36Y, 36C and 36M to the color heads 13. The inks of yellow, cyan and magenta are jetted from the nozzles 31 of the color heads 13 forming the three nozzle arrays 32, respectively, from left to right in FIG. 2. Here, the color heads 13 include not only the plurality of nozzles 31 but also, for example, a plurality of unshown pressure chambers in respective communication with the nozzles 31, an unshown actuator for applying a pressure to the color inks in the pressure chambers, and the like. By applying the pressure to the inks in the pressure chambers, the color inks are jetted through the nozzles 31 by the actuator. Further, in the black heads 12 and the color heads 13, the pressure mechanism for applying the pressure to the inks is not limited to an actuator. For example, a heater may as well be adopted as the pressure mechanism to apply the jet pressure to the inks by heating the inks in the pressure chambers to form air bubbles.

Then, the printer 1 carries out black-and-white printing by jetting the black ink from the black heads 12, and carries out color printing by jetting the three color inks from the color heads 13.

Figure 4:
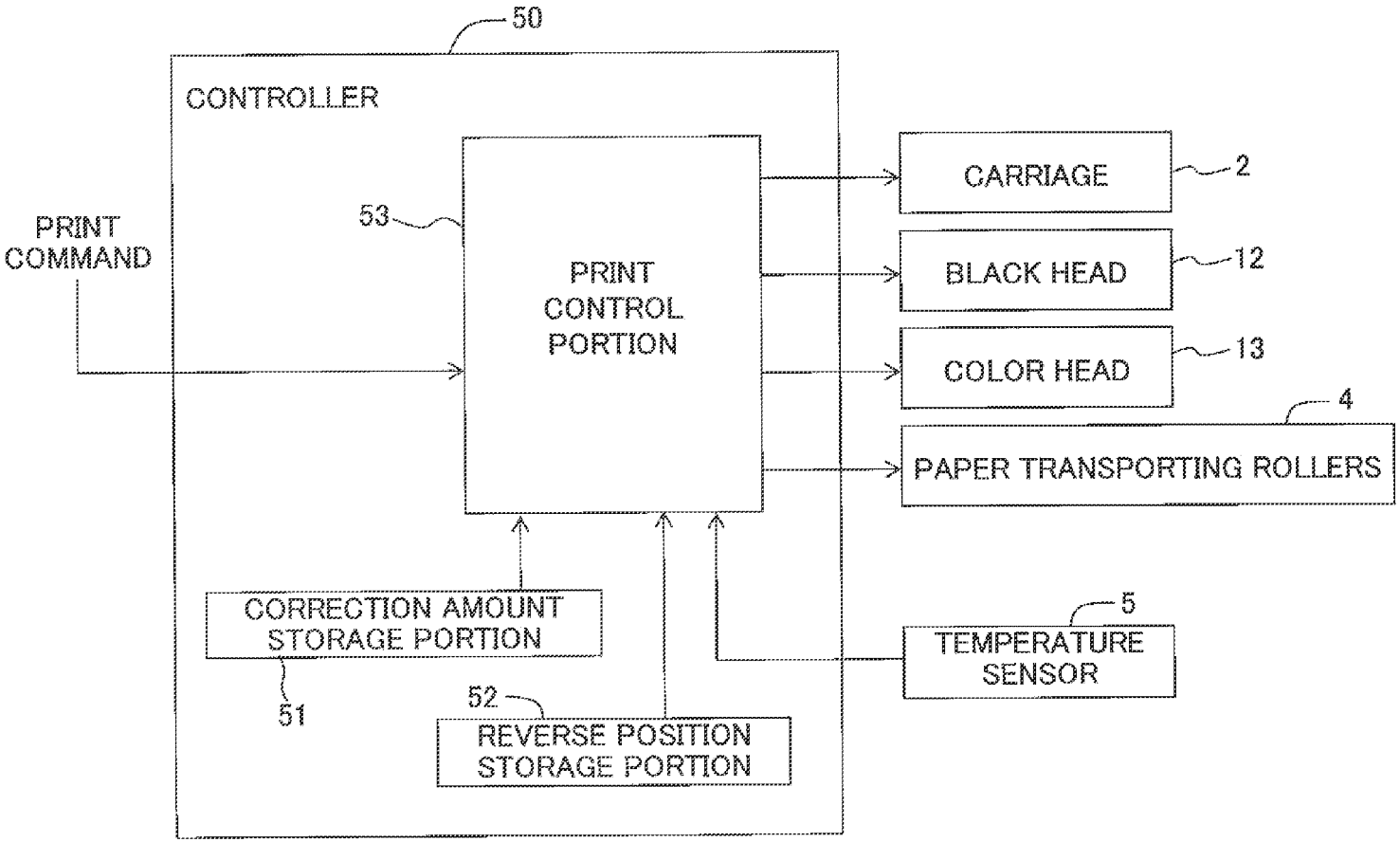
FIG. 4 is a functional block diagram of a control device of the printer of FIG. 1.

Next, explanations will be made with respect to the controller 50 for controlling the operations of the printer 1. The controller 50 includes a Central Processing Unit (CPU), a Read Only Memory (ROM), a Random Access Memory (RAM), and the like. As shown in FIG. 4, these components operate in the form of a correction amount storage portion 51, a reverse position storage portion 52, a print control portion 53, and the like.

The correction amount storage portion 51 stores a table showing a relationship between the temperature of the head holding plate 11 and the correction amount of the jet timing of the plurality of nozzles 31. Alternatively, the correction amount storage portion 51 can store a table showing a relationship between an environmental temperature in the vicinity of the head holding plate 11 and the correction amount of the jet timing of the plurality of nozzles 31. Similarly, the reverse position storage portion 52 stores a table showing a relationship between the temperature of the head holding plate 11 or an environmental temperature in the vicinity of the head holding plate 11, and the reverse position of the movement direction of the carriage 2. Here, the reverse position shown in the table of the reverse position storage portion 52 is set to be further outside in the scanning direction in correspondence with a higher temperature.

The print control portion 53 controls the operations of the black heads 12 and the color heads 13 when the printer 1 carries out printing. In particular, the print control portion 53 decides the correction amount by reading out the correction amount of the jet timing corresponding to the temperature detected by the temperature sensor 5 from the correction amount storage portion 51. Then, it adjusts the jet timing by the read-out correction amount for the case of not carrying out correction, so as to adjust the jet timing and then cause the nozzles 31 to jet the inks.

Further, the print control portion 53 controls the operation of the carriage 2 when the printer 1 carries out printing. In particular, the print control portion 53 reads out the reverse position of the movement of the carriage 2 corresponding to the temperature detected by the temperature sensor 5 from the reverse position storage portion 52, and causes the carriage 2 to reciprocate in the scanning direction such that the movement direction of the carriage 2 is reversed at the read-out reverse position. Further, the print control portion 53 also controls the operation of the paper transporting rollers 4 when the printer 1 carries out printing, etc.

Here, in the printer 1, if the temperature of the head holding plate 11 rises due to a change in the environmental temperature and the like, then the head holding plate 11 is subjected to expansion. However, because the head holding plate 11 is sandwiched on both ends in the paper feeding direction by the two regulating members 26*a* and 26*b*, it is constrained from extension in the paper feeding direction. Therefore, even if the temperature of the head holding plate 11 rises, the head holding plate 11 does not extend in the portions between the black heads 12 and between the color heads 13 in the paper feeding direction. Hence, no deviations may occur in the nozzles 31 in the nozzle array direction parallel to the paper feeding direction.

On the other hand, because in this case the head holding plate 11 extends in the scanning direction perpendicular to the nozzle array direction, deviations do occur in the nozzles 31 in the scanning direction between the plurality of black heads 12 and between the plurality of color heads 13, respectively. Therefore, in the embodiment, by adjusting the jet timing of the inks from the nozzles 31 based on the temperature detected by the temperature sensor 5, the ink landing position on the recording paper P is corrected in the scanning direction.

At this time, in the embodiment as described hereinabove, the positioning pin 27 and the eccentric cam 28 sandwich the head holding plate 11 to constrain or restrict the reference portion thereof positioned between the two notches 24*a* and 24*b*. Therefore, even if the head holding plate 11 expands due to temperature rise, the reference portion of the head holding plate 11 is still prevented from displacement not only in the paper feeding direction as a matter of course, also in the scanning direction as well.

Further, because the head holding plate 11 is sandwiched by the two regulating members 26*a* and 26*b*, other portions than the reference portion are restrained from extension in the paper feed direction, but are able to extend in the scanning direction. Here, according to the perception of the present inventors, when the head holding plate 11 has expanded, the amount of displacement of each nozzle 31 in the scanning direction is determined by the temperature of the head holding plate 11 and the distance from the above reference portion of the head holding plate 11. Thereby, it is possible to accurately apprehend the amount of displacement of each nozzle 31. Hence, as described hereinbefore, when the landing position is corrected by adjusting the jet timing of the inks from the nozzles 31, it is possible to accurately correct the landing position.

Further, at this time, when a region R1 of the head holding plate 11 is defined to be the region of arranging the four black heads 12 and the four color heads 13, then the region R1 is constrained in the approximately central portion thereof in the scanning direction. That is, among the plurality of nozzle arrays 32 formed by the four black heads 12 and the four color heads 13, if the nozzle arrays 32 positioned the most outside in the scanning direction are referred to as the outmost nozzle arrays, then the head holding plate 11 is constrained in the portion inside of the outmost nozzle columns in the scanning direction. In particular, the restricted portion is positioned inside of the nozzle array 32 of the two black heads 12 on the left side in FIG. 2, and the rightmost nozzle array 32 of the color heads 13 on the right side in FIG. 2. Therefore, each of the nozzles 31 is positioned near the reference portion of the head holding plate 11 and, thereby, the amount of displacement of each of the nozzles 31 becomes small in the scanning direction when the head holding plate 11 has expanded. By virtue of this, the correction amount of the landing position also becomes small.

Here, in the case of a large correction amount of the landing position, which is different from the embodiment, if there is any difference between the appropriate jet timing and the actual jet timing after correction, the ink landing position will deviate greatly. As a result, there is a risk of failing to accurately correct the ink landing position. In the embodiment, however, because it is possible to reduce the correction amount of the landing position just as described hereinabove, it is possible to accurately correct the landing position.

Further, in the embodiment, the positioning pin 27 and eccentric cam 28 sandwich the portion of the head holding plate 11 positioned between the two notches 24*a* and 24*b* from the paper feeding direction so as to constrain the head holding plate 11 from displacement in both the paper feeding direction and the scanning direction. Therefore, it is possible to easily constrain the head holding plate 11, and easily form the reference portion.

Further, because the positioning pin 27 and eccentric cam 28 engage the notches 24*a* and 24*b* respectively, the portion of the head holding plate 11 positioned between the two notches 24*a* and 24*b* will not glide off in the scanning direction with respect to the positioning pin 27 and the eccentric cam 28. Therefore, even when the positioning pin 27 and the eccentric cam 28 do not tightly sandwich the head holding plate 11, it is still possible to constrain the reference portion of the head holding plate 11 from displacement in the paper width direction.

Further, in the embodiment, the reference portion of the head holding plate 11 constrained by the positioning pin 27 and the eccentric cam 28 overlaps the through holes 22 so that the nozzle surfaces 13*a* of the color heads 13 are exposed in the nozzle array direction. Here, the peripheral portion of the region of forming the through holes 22 in head holding plate 11 has a lower rigidity than other portions in the head holding plate 11. In other words, the rigidity of the peripheral portion of the through holes becomes lowered by the through holes. Therefore, when the positioning pin 27 and the eccentric cam 28 sandwich the head holding plate 11 to constrain the holding plate 11, the stress exerted on the head holding plate 11 becomes smaller. By virtue of this, it is possible to prevent the head holding plate 11, the positioning pin 27, the eccentric cam 28 and the like from destruction by the stress exerted in constraining the reference portion.

Further, the printer 1 of the embodiment carries out printing by jetting the inks from the nozzles 31 of the head unit 3 reciprocating along with the carriage 2 in the scanning direction. Therefore, as shown in FIGS. 5A and 5B for example, in order to print in a certain region S of the recording paper P, it is necessary to reverse the movement direction of the carriage 2 after moving the carriage 2 to such a position as the region R1 of arranging the black heads 12 and the color heads 13 has come outside of the region S in the paper width direction.

Figures 5A, 5B:
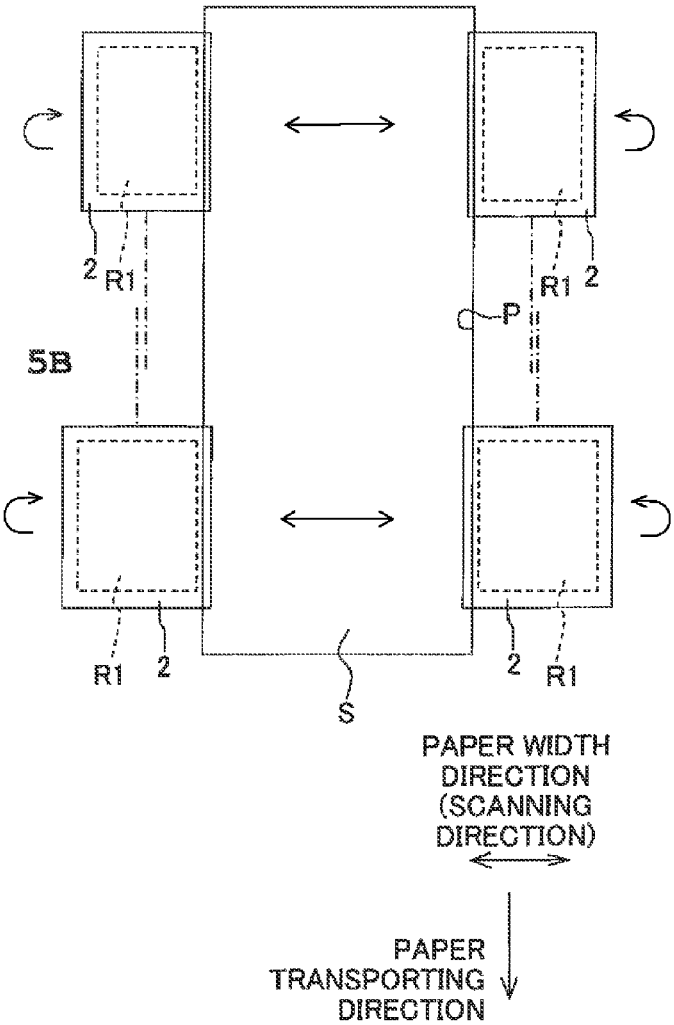
FIGS. 5A and 5B show a relationship between expansion and contraction of a head holding plate and reverse position of a carriage.

On the other hand, as understood by comparison between FIG. 5A and FIG. 5B, if the head holding plate 11 extends in the scanning direction as described hereinbefore, then the region R1 expands or widens in the scanning direction. Therefore, it is necessary to move the carriage 2 further outside in the scanning direction to such an extent as the region R1 is widened.

At this time, if, by assumption, the carriage 2 is controlled such that the movement direction of the carriage 2 is reversed at a certain position regardless of the temperature of the head holding plate 11, then it is necessary to adapt the reverse position of the movement direction of the carriage 2 to the reverse position when the head holding plate 11 has expanded. In this case, even though the temperature is low and thus the head holding plate 11 has not expanded, the carriage 2 is still moved unnecessarily to the outside in the scanning direction.

In contrast, in the embodiment as described hereinbefore, if a higher temperature is detected by the temperature sensor 5, then the movement direction is reversed as the carriage 2 is located further outside in the scanning direction. Therefore, it is possible to restrict the displacement of the carriage 2 to such an extent as is necessary for the region R1 to move outside of the region S. Then, because the displacement of the carriage 2 can be minimized, it is possible to reduce unnecessary movement of the carriage 2, thereby enabling to raise the print speed.

Next, explanations will be made with respect to a few modifications applying various changes to the above embodiment. Note that, however, explanations will be omitted as appropriate with respect to the constitutive parts or components which are the substantially same as or substantially equivalent to those of the embodiment.

In the above embodiment, the positioning pin 27 and the eccentric cam 28 constrain the approximately central portion in the scanning direction of the region R1 of arranging the four black heads 12 and the four color heads 13 on the head holding plate 11. However, the present teaching is not limited to such configuration.

Figure 6:
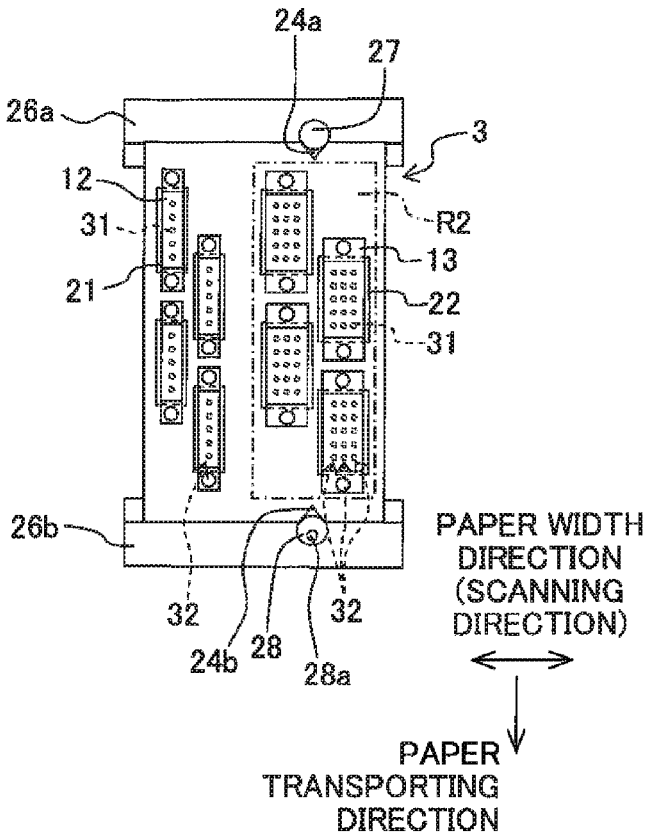
FIG. 6 is a view corresponding to FIG. 2 in accordance with a first modification.

In a first modification as shown in FIG. 6, the notches 24*a* and 24*b* of the head holding plate 11 and the positioning pin 27 and eccentric cam 28 constrain the approximately central portion in the scanning direction of a region R2 of arranging the four color heads 13 on the head holding plate 11. Thus, the portion sandwiched by the positioning pin 27 and the eccentric cam 28 becomes the reference portion of the head holding plate 11. That is, the positioning pin 27 and the eccentric cam 28 constrain the portion of the head holding plate 11 positioned inside of the outmost nozzle columns 32 of the four color heads 13 in the scanning direction. In particular, the restricted portion of the head holding plate 11 is positioned inside of the leftmost nozzle array 32 of the two color heads 13 on the left side in FIG. 6 as well as inside of the rightmost nozzle column 32 of the two color heads 13 on the right side in FIG. 6.

At this time, the distance between the reference portion and the nozzle column 32 of the black heads 12 farthest away from the reference portion is larger than the distance between the reference portion and the nozzle array 32 of the color heads 13 farthest away from the reference portion.

In this case, the nozzles 31 of the color heads 13 are located in a position closer to the above reference portion of the head holding plate 11 than the nozzles 31 of the black heads 12. Therefore, the displacement of the nozzles 31 of the color heads 13 becomes smaller in the scanning direction when the head holding plate 11 extends in the scanning direction. Consequently, a small correction amount of the landing position is sufficient for the nozzles 31 of the color heads 13, and thereby it is possible to accurately correct the landing position of the color inks on the recording paper P when a high degree of accuracy in the landing position is required for color print.

Further, in this case, in comparison with the aforementioned embodiment, because the nozzles 31 of the black heads 12 are farther away from the reference portion of the head holding plate 11 in the scanning direction, the displacement of the nozzles 31 of the black heads 12 becomes larger in the paper width direction when the head holding plate 11 extends in the paper width direction. As a result, the correction amount of the landing position also becomes larger for the nozzles 31 of the black heads 12. However, since black-and-white print does not require so high a degree of accuracy in the landing position as color print, even though there is a little deviation in the landing position due to a large correction amount of the landing position, the influence on the image quality is still small.

Further, in the first modification, as the reference portion, the restricted portion of the head holding plate 11 is inside of the outmost nozzle columns 32 in the scanning direction among the nozzle arrays 32 formed by the color heads 13. However, the present teaching is not limited to such configuration. The reference portion may be arranged in any region inside of the outmost nozzle arrays of the head holding plate 11 in the scanning direction. For example, as the reference portion, the restricted portion of the head holding plate 11 may as well be inside of the outmost nozzle arrays 32 in the scanning direction among the nozzle arrays 32 formed by the color heads 13, and be such that the distance between the reference portion and the nozzle array 32 of the black heads 12 farthest away from the reference portion becomes larger than the distance between the reference portion and the nozzle array 32 of the color heads 13 farthest away from the reference portion.

In this case too, because the nozzles 31 of the color heads 13 become closer to the reference portion than the nozzles 31 of the black heads 12, the displacement of the nozzles 31 of the color heads 13 becomes smaller when the head holding plate 11 has extended.

Further, the distance between the reference portion and the nozzle array 32 of the black heads 12 farthest away from the reference portion may as well not be necessarily larger than the distance between the reference portion and the nozzle array 32 of the color heads 13 farthest away from the reference portion. That is, other parts of the head holding plate 11 than the above may as well be constrained in so far as inside of the outmost nozzle columns 32 in the paper width direction among the nozzle arrays 32 formed by the black heads 12 and the color heads 13.

Further, in the aforementioned embodiment, although the head unit 3 has the four black heads 12 and the four color heads 13 retained on the head holding plate 11, the present teaching is not limited to such configuration. The head unit 3 can include arbitrary number of the black heads 12 and the color heads 13. For example, the head unit 3 can include not more than three black heads 12 and not more than three color heads 13. Alternatively, the head unit 3 can include not less than five black heads 12 and not less than five color heads 13. Further, the number of black head 12 can be different from the number of color head 13.

Figure 7:
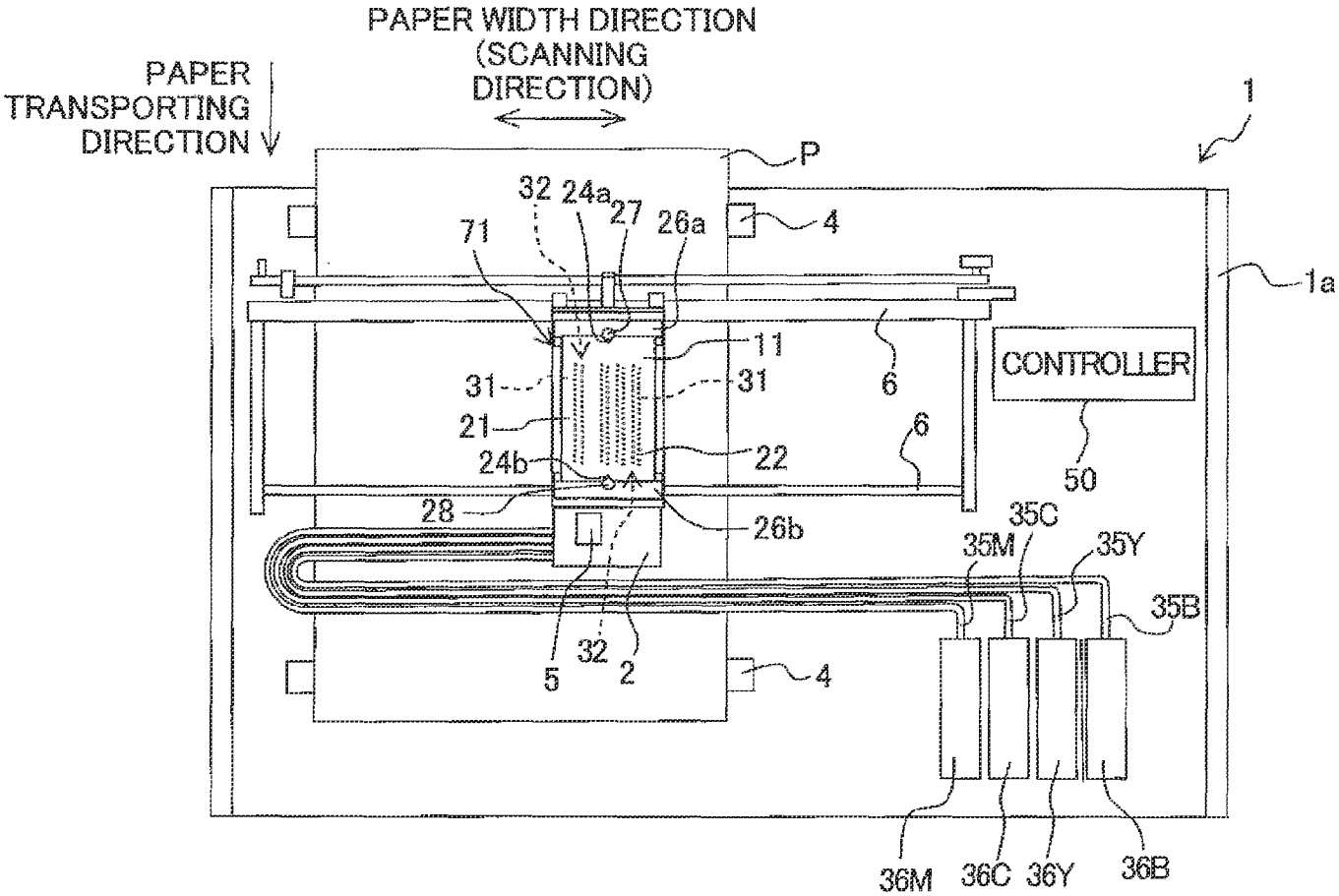
FIG. 7 is a diagram corresponding to FIG. 1 in accordance with a second modification.

In a second modification as shown in FIG. 7, an ink jet head 71 is provided on the carriage 2 to form therein both the nozzles 31 for jetting the black ink and the nozzles 31 for jetting the three color inks. In more detail, in the ink jet head 71, the plurality of nozzles 31 are aligned along the paper feeding direction parallel to the nozzle column direction for jetting the black ink, yellow ink, cyan ink and the magenta ink, respectively. With this alignment, two nozzle arrays 32 are formed for each color. That is, in the second modification, the head unit in accordance with the present teaching corresponds to one ink jet head 71 as the liquid jetting head.

Then, the two regulating members 26*a* and 26*b* are arranged to sandwich the ink jet head 71 from the paper feeding direction, and the portion of the ink jet head 71 sandwiched by the positioning pin 27 and the eccentric cam 28 is the reference portion. That is, the ink jetting head 71 is constrained in the reference portion positioned between the positioning pin 27 and the eccentric cam 28.

In this case, the ink jet head 71 expands if the temperature of the ink jetting head 71 rises but, in the same manner as in the aforementioned embodiment, the regulating members 26*a* and 26*b* regulate the ink jetting head 71 from extension in the paper feeding direction parallel to the nozzle column direction. Further, the ink jetting head 71 extends at this time in the scanning direction but, still in the same manner as in the embodiment, each nozzle 31 is displaced by an amount according to the distance from the above reference position in the scanning direction. Here, because each nozzle 31 is located near the reference position, it is possible to restrict the displacement of each nozzle 31 to a small amount. Therefore, by adjusting the jet timing of the inks from the nozzles 31, it is possible to accurately correct the ink landing position on the recording paper P in the paper width direction.

Further, in the above description, the ink landing position on the recording paper P is corrected by adjusting the jet timing of the inks from the nozzles 31. However, the present teaching is not limited to such configuration. The ink landing position on the recording paper P may as well be corrected by other methods such as adjusting the moving speed of the carriage 2 based on the temperature detected by the temperature sensor 5, and the like.

Further, in the aforementioned embodiment, the movement direction of the carriage 2 is reversed further outside in the scanning direction as the temperature detected by the temperature sensor 5 is higher. However, the present teaching is not limited to such configuration, but the movement direction of the carriage 2 may as well be reversed at a certain position regardless of the detected temperature. In this case, however, as described hereinbefore, it is necessary to set the reverse position of the movement of the carriage 2 to an outside place in the scanning direction, according to the case of the expanded head holding plate 11.

Further, in the aforementioned embodiment, the correction amount of the jet timing is read out from the correction amount storage portion 51 according to the temperature detected by the temperature sensor 5. However, the present teaching is not limited to such configuration but, for example, the correction amount of the jet timing may as well be calculated from the temperature detected by the temperature sensor 5, etc.

Further, in the aforementioned embodiment, although the scanning direction of the carriage 2 is parallel to the paper width direction, it may as well be a direction oblique to the paper width direction in so far as the scanning direction intersects the paper feeding direction.

Further, the above description is made with respect to an example of applying the present teaching to a so-called serial printer, which carries out printing on the recording paper P by jetting inks from nozzles of a head unit reciprocating along with a carriage in the scanning direction. However, the present teaching is not limited to such configuration.

Figure 8:
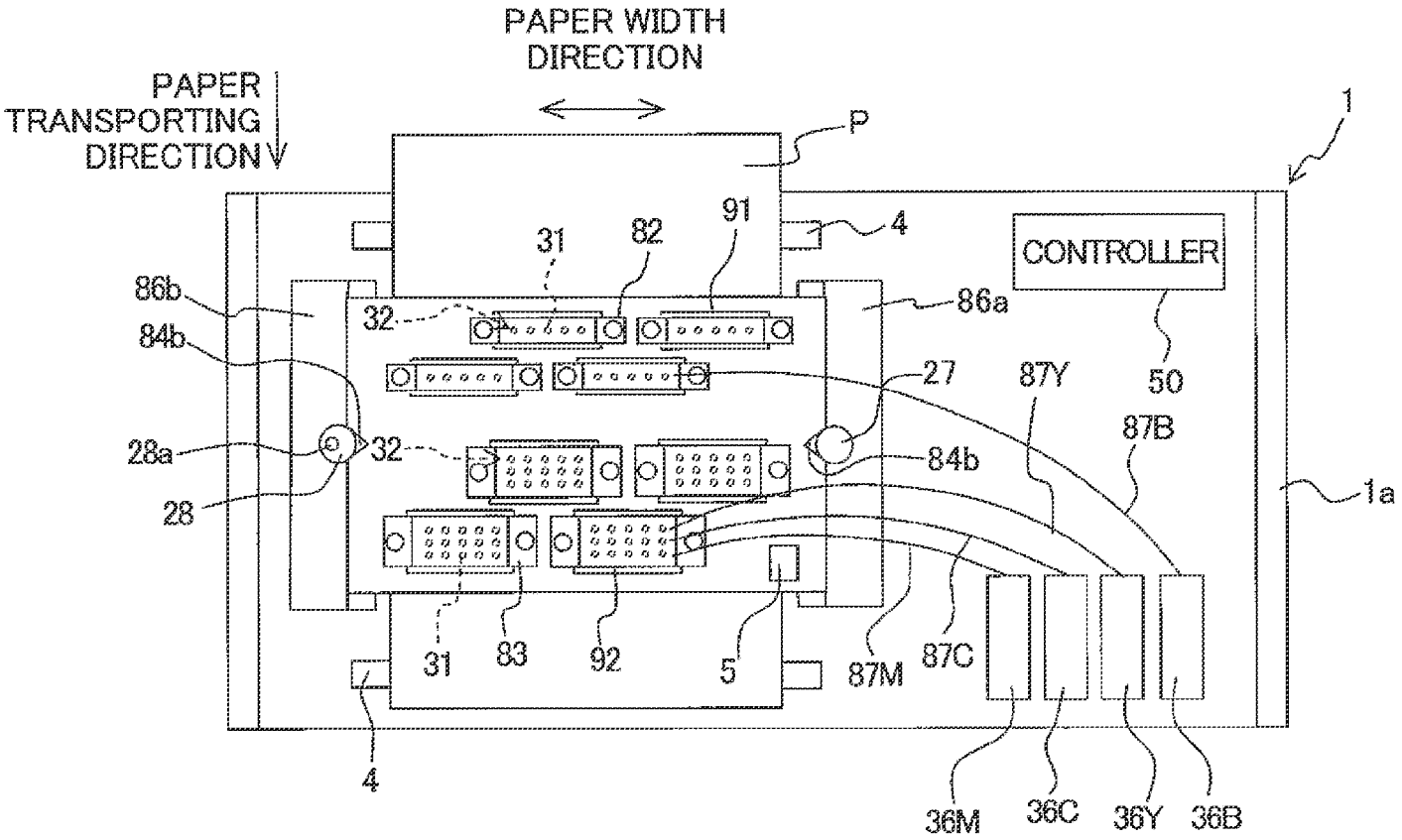
FIG. 8 is a diagram corresponding to FIG. 1 in accordance with a third modification.

In a third modification, the present teaching is applied to a printer provided with a so-called line head. As shown in FIG. 8, a head unit 80 includes a head holding plate 81, four black heads 82, and four color heads 83.

The head holding plate 81 is an approximately rectangular plate-like member made of a ceramic material or the like and is arranged so that the longitudinal direction thereof is substantially parallel to the paper width direction. Further, four through holes 91 and four through holes 92 are formed in the head holding plate 81 on the upper side and on the lower side with respect to FIG. 8, respectively. The four through holes 91 and the four through holes 92 are approximately rectangular through holes, and are arranged so that the longitudinal direction thereof is substantially parallel to the paper width direction. Further, the four through holes 91 are aligned in a zigzag pattern along the paper width direction respectively. Further, at both ends of the head holding plate 81 in the paper width direction, notches 84*a* and 84*b* similar to the notches 24*a* and 24*b* are formed in the approximately central portion in the paper feeding direction perpendicular to the paper width direction. Further, the temperature sensor 5 is arranged on the upper surface of the head holding plate 81.

The four black heads 82 have the same configuration as the black heads 12 (see FIG. 1). In particular, the four black heads 82 are aligned on the upper surface of the head holding plate 81 in a zigzag pattern along the paper width direction such that the nozzle surfaces 12*a* (see FIG. 3) are exposed through the through holes 91 with the plurality of nozzles 31 of such an orientation as to align in the paper width direction parallel to the nozzle array direction. Further, the four black heads 82 are connected to the black cartridge 36B through a tube 87B. Further, although the four black heads 82 are connected to the black cartridge 36B individually through the tube 87B, in order to make the figure easy to see, only one tube 87B is shown in FIG. 8.

The four color heads 83 have the same configuration as the color heads 13 (see FIG. 1). In particular, the four color heads 83 are aligned on the upper surface of the head holding plate 81 in a zigzag pattern along the paper width direction such that the nozzle surfaces 13*a* (see FIG. 3) are exposed through the through holes 92 with the plurality of nozzles 31 of such an orientation as to align in the paper width direction. Further, the four color heads 83 are connected to the three color cartridges 36Y, 36C and 36M through three tubes 87Y, 87C and 87M. Further, although the four color heads 83 are connected to the color cartridges 36Y, 36C and 36M individually through the tubes 87Y, 87C and 87M, in order to make the figure easy to see, only one set of the tubes 87Y, 87C and 87M is shown in FIG. 8.

Further, on both sides of the head holding plate 81 in the paper width direction, regulating members 86*a* and 86*b* fixed on the printer body 1*a* are provided to fix the head unit 80 to the printer body 1*a* and constrain the head holding plate 81 from extension in the paper width direction. Further, the regulating members 86*a* and 86*b* are provided with the same positioning pin 27 and eccentric cam 28 as in the aforementioned embodiment, respectively. The positioning pin 27 and the eccentric cam 28 sandwich and thus constrain or restrict a reference portion of the head holding plate 81 positioned between two notches 84*a* and 84*b*.

Then, the printer of the third modification carries out black-and-white printing by jetting the black ink from the four black heads 82 fixed to the printer body 1*a* to the recording paper P transported by the paper transporting rollers 4 in the paper feeding direction. Further, it carries out color printing by jetting the color inks from the four color heads 83 fixed to the printer body 1*a* to the recording paper P transported by the paper transporting rollers 4 in the paper feeding direction.

Then, in this case, because the regulating members 86*a* and 86*b* restrict the head holding plate 81 from extension in the paper width direction parallel to the nozzle array direction when the head holding plate 81 is expanding due to temperature rise, it is possible to prevent the nozzles 31 from deviation in the nozzle array direction between the black heads 82, and between the color heads 83.

Further, although the head holding plate 81 extends at this time in the paper feeding direction and thus the nozzles 31 are displaced in the paper feeding direction, by adjusting the jet timing of the inks from the nozzles 31 according to the temperature detected by the temperature sensor 5, it is possible to correct the ink landing position on the recording paper P in the paper feeding direction.

Figure 9:
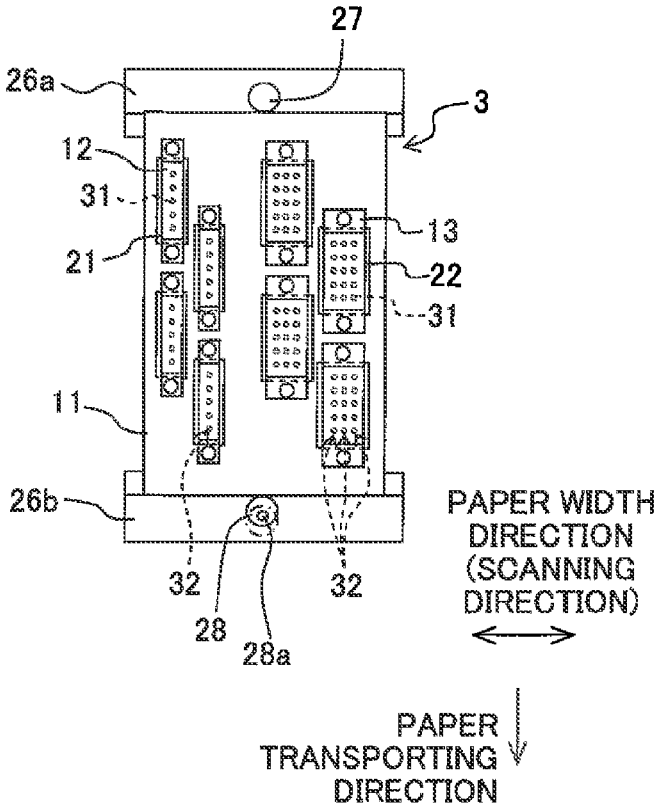
FIG. 9 is a view corresponding to FIG. 2 in accordance with a fourth modification.

Further, in the above examples, the positioning pin 27 and the eccentric cam 28 sandwiching the head holding plate engage the notches formed in the head holding plate, respectively. However, the present teaching is not limited to such configuration. As in a fourth modification shown in FIG. 9, for example, the notches 24*a* and 24*b* (see FIG. 2) may as well not be formed in the head holding plate 11. That is, the positioning pin 27 and the eccentric cam 28 may as well sandwich the head holding plate 11 with no notches. Further, it is possible in this case to provide the positioning pin 27, and the eccentric cam 28 in the position shown in FIG. 9 with a solid line to stand out a little inward from the regulating members 26*a* and 26*b* before the head holding plate 11 is fitted, for example, so as to let the positioning pin 27 and the eccentric cam 28 exert a sandwiching force on the head holding plate 11.

Figure 10:
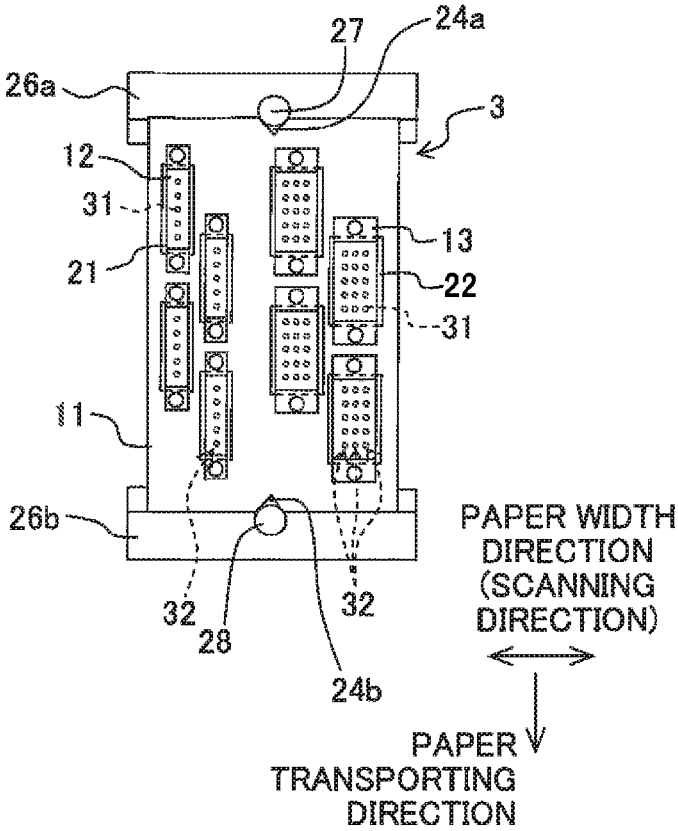
FIG. 10 is a view corresponding to FIG. 2 in accordance with a fifth modification.

Further, in the present teaching, the head holding plate may as well not be necessarily sandwiched by the positioning pin 27 and the eccentric cam 28. For example, another pair of sandwiching members may sandwich and constrain the portion of the head holding plate therebetween. For example, as in a fifth modification shown in FIG. 10, the head holding plate 11 may as well be sandwiched by two irrotational positioning pins 27 provided on the regulating members 26*a* and 26*b* respectively. Further, the pair of sandwiching members for sandwiching the head holding plate may as well not be necessarily fixed on the regulating members 26*a* and 26*b*, but be fixed on other fixation portions such as the carriage 2 and the like.

Further, the present teaching is not limited to the configuration of restricting the reference portion by sandwiching the head holding plate. For example, the reference portion of the head holding plate may as well be restricted by other members than those sandwiching the head holding plate.

Figure 11:
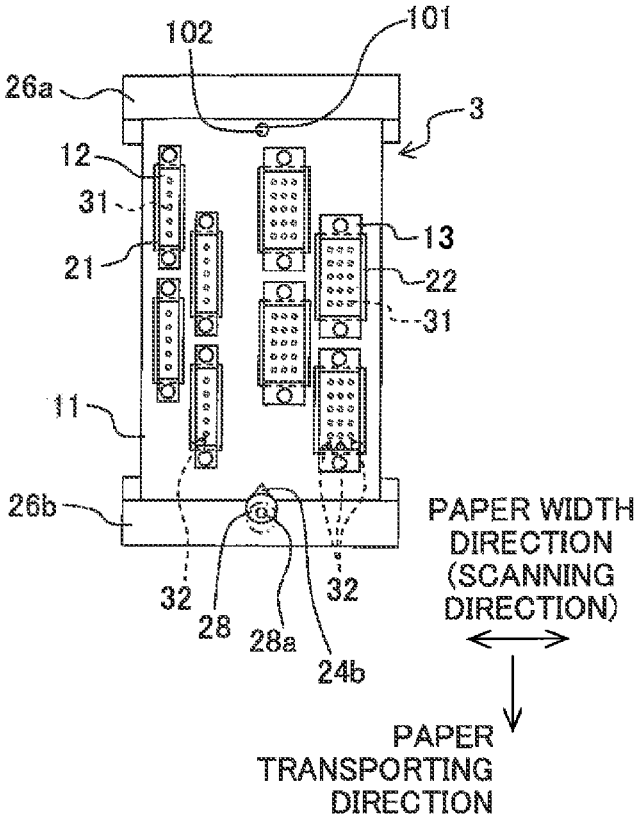
FIG. 11 is a view corresponding to FIG. 2 in accordance with a sixth modification.

For example, in a sixth modification shown in FIG. 11, instead of the notch 24*a* (see FIG. 2), a through hole 101 is formed in the end portion of the head holding plate 11 on the regulating member 26*a* side in the longitudinal direction. Further, a pin 102 is provided on the portion of the regulating member 26*a* facing the through hole 101 and supporting the bead holding plate 11 from below. The pin 102 is fitted into the through hole 101, and the through hole 101 and the pin 102 are in a relation of transition fit or interference fit.

In this case, when fitting the head holding plate 11 on the regulating members 26*a* and 26*b*, with the eccentric cam 28 positioned outside of the notch 24*b*, the head unit 3 is placed between the two regulating members 26*a* and 26*b*. Then, the eccentric cam 28 is rotated approximately 180 degrees while fitting the pin of the regulating member 26*a* into the through hole 101 of the head holding plate 11. Thus, the eccentric cam 28 and the pin 102 constrain the reference portion of the head holding plate 11 positioned between the notch 24*b* and the through hole 101 from displacement.

Further, in the sixth modification, the through hole 101 is formed in the head holding plate 11 and the pin 102 is provided on the regulating member 26*a*. In contrast to this, however, a pin may be formed on the lower surface of the head holding plate 11, while a hole is formed in the regulating member 26*a* to fit the pin thereinto.

Further, in the aforementioned embodiment, the explanations were made with the case that as the head for printing at low image quality, the head unit 3 includes the black heads 12 having the nozzle columns 32 formed by the nozzles 31 to jet the black ink as the nozzles for printing at low image quality, while as the head for printing at high image quality, the head unit 3 includes the color heads 13 having the nozzle columns 32 formed by the nozzles 31 to jet the color inks as the nozzles for printing at high image quality. However, the present teaching is not limited to this configuration of combining the head for printing at low image quality with the head for printing at high image quality.

For example, as the head for printing at low image quality, the head unit 3 may include a black head with a certain nozzle interval and, further, as the bead for printing at high image quality, the head unit 3 may include another black head with a nozzle interval shorter than that of the head for printing at low image quality. Alternatively, as the head for printing at low image quality the head unit 3 may include a black head with a certain nozzle diameter and, further, as the head for printing at high image quality, the head unit 3 may include another black head with a nozzle diameter smaller than that of the head for printing at low image quality. Still alternatively, as the head for printing at low image quality, the head unit 3 may include an ink jet head configured to jet ink droplets of a certain volume and, further, as the head for printing at high image quality, the head unit 3 may include another ink jet head which has the same structure as the head for printing at low image quality but is configured to jet ink droplets of a smaller volume than that of the head for printing at low image quality by a different drive waveform.

Further, the head unit is also not limited to including the two types of nozzle arrays as for printing at low image quality and for printing at high image quality. The head unit may as well include only one type of nozzle columns such as only the nozzle column formed by the nozzles 31 for jetting the black ink, or the like.

Further, in the aforementioned embodiment, the through holes 21 and 22 are formed in the head holding plate 11, and the nozzle surfaces 12*a* of the black heads 12 and the nozzle surfaces 13*a* of the color heads 13 are in such a structure as exposed on the lower side from the through holes 21 and 22, respectively. Then, the portion of the head holding plate 11 overlapping the through holes 22 in the nozzle array direction is restricted as the reference portion. However, the present teaching is not limited to such configuration. For example, the restricted portion of the head holding plate 11 may as well overlap the through holes 21 in the nozzle array direction, or overlap neither the through holes 21 nor the through holes 22 in the nozzle array direction. Further, the structure may as well be such that the through holes 22 are not formed in the head holding plate 11, but the black heads 12 and the color heads 13 are fixed on the lower surface of the head holding plate 11. Further, in the above embodiments and modifications, a nozzle plate is provided for each head (the black head 12 and the color head 13) to constitute the nozzle surfaces of the plurality of heads. However, the present teaching is not necessarily limited to such configuration. The nozzle plate may as well be provided in common for some or all of the heads to constitute the nozzle surface or surfaces of the plurality of heads.

Further, in the aforementioned embodiment, although the ink landing position is corrected based on the temperature detected by the temperature sensor 5, the present teaching is not limited to such configuration. For example, the user may manipulate an unshown operating portion of the printer to input the environmental temperature of the printer in use and adjust the ink landing position based on the inputted temperature. Alternatively, by measuring the stress on the head holding plate 11 expanded or contracted due to temperature change, and estimating the amount of expansion or contraction of the head holding plate 11 from the intensity of the measured stress, the ink landing position may as well be corrected according to the estimated amount of expansion or contraction of the head holding plate 11.

Further, the above explanations were made with an example of applying the present teaching to a printer carrying out printing by jetting inks from nozzles. However, the present teaching is not limited to this application but is applicable to liquid jet apparatuses for jetting other liquids than inks to jet objects.

What is claimed is:

1. A liquid jetting apparatus which jets a liquid onto a medium, comprising:

a head unit including a liquid jetting head in which a plurality of nozzles are formed, the plurality of nozzles being aligned in a nozzle array direction to form a plurality of nozzle arrays along an orthogonal direction perpendicular to the nozzle array direction;

a regulating member arranged to sandwich the head unit from the nozzle array direction so that the regulating member regulates the head unit from expansion and contraction due to temperature change along the nozzle array direction;

a restriction mechanism configured to restrict the head unit from displacement in the orthogonal direction perpendicular to the nozzle array direction under a condition that the head unit is expanding or contracting due to temperature change; and a landing position correction mechanism configured to correct position of landing the liquid jetted from the plurality of nozzles onto the medium in the orthogonal direction under a condition that the head unit is expanding or contracting due to temperature change;

wherein the restriction mechanism is arranged inside of outmost nozzle arrays in the orthogonal direction so as to restrict a portion of the head unit inside of the outmost nozzle arrays from displacement in the orthogonal direction.

2. The liquid jetting apparatus according to claim 1;

wherein the head unit includes:

a plurality of the liquid jetting heads each of which includes at least one nozzle array in which the plurality of nozzles are aligned in the nozzle array direction and which is arranged so that the at least one nozzle array align along the orthogonal direction perpendicular to the nozzle column direction; and a holding member con figured to hold the plurality of liquid jetting heads;

wherein the regulating member is arranged to sandwich the holding member from the nozzle array direction so as to regulate the holding member from expansion and contraction due to temperature change along the nozzle array direction; and wherein the restriction mechanism restricts a portion of the holding member inside of the outmost nozzle arrays in the orthogonal direction.

3. The liquid jetting apparatus according to claim 2;

wherein a plurality of through holes are formed in the holding member to correspond to the plurality of liquid jetting heads;

wherein the plurality of liquid jetting heads have nozzle surfaces in which the plurality of nozzles are formed and which are exposed from the through holes, respectively; and wherein the restriction mechanism restricts a portion of the holding member overlapping the through holes in the nozzle array direction.

4. The liquid jetting apparatus according to claim 1;

wherein the head unit includes the liquid jetting head including a plurality of nozzle arrays formed in rows along the orthogonal direction, respectively, and the plurality of nozzles are aligned in the nozzle array direction; and wherein the restriction mechanism restricts a portion of the liquid jetting head inside of the outmost nozzle arrays in the orthogonal direction.

5. The liquid jetting apparatus according to claim 1;

wherein the plurality of nozzle arrays include:

a plurality of nozzle arrays for high image quality configured to print at high image quality and configured to jet ink for printing at high image quality; and a plurality of nozzle arrays for low image quality configured to print at low image quality and configured to jet ink for printing at low image quality;

wherein the plurality of nozzle arrays for high image quality are arranged in rows along the orthogonal direction; and wherein the restriction mechanism constrains a portion of the head unit inside of the outmost nozzle arrays for high image quality in the orthogonal direction.

6. The liquid jetting apparatus according to claim 5;

wherein the nozzle arrays for high image quality include a plurality of nozzles for jetting color inks; and wherein the nozzle arrays for low image quality include a plurality of nozzles for jetting a black ink.

7. The liquid jetting apparatus according to claim 1;

wherein the plurality of nozzle columns includes:

a plurality of nozzle arrays for high image quality configured to print at high image quality and configured to jet ink for printing at high image quality; and a plurality of nozzle arrays for low image quality configured to print at low image quality and configured to jet ink for printing at low image quality; and wherein the restriction mechanism restricts a part of the head unit so that the distance between the part and the farthest nozzle array for low image quality in the orthogonal direction becomes larger than the distance between the part and the farthest nozzle array for high image quality.

8. The liquid jetting apparatus according to claim 7;

wherein the nozzle arrays for high image quality include a plurality of nozzles for jetting color inks; and wherein the nozzle arrays for low image quality include a plurality of nozzles for jetting a black ink.

9. The liquid jetting apparatus according to claim 1, further comprising:

a temperature detection mechanism configured to detect a temperature of the head unit directly or indirectly;

wherein the landing position correction mechanism corrects the landing position based on the temperature detected by the temperature detection mechanism.

10. The liquid jetting apparatus according to claim 9, further comprising:

a correction value storage mechanism configured to store a table associating the temperature detected by the temperature detection mechanism with a correction value corresponding to expansion and contraction of the head unit in the orthogonal direction;

wherein the landing position correction mechanism decides the correction value from the table in correspondence with the temperature detected by the temperature detection mechanism, and corrects the landing position based on the correction value.

11. The liquid jetting apparatus according to claim 1;

wherein the landing position correction mechanism corrects the landing position by adjusting a jet timing of the liquid from the plurality of nozzles.

12. The liquid jetting apparatus according to claim 1, further comprising:

a carriage configured to carry the head unit thereon and to move reciprocatingly in a scanning direction intersecting the nozzle array direction;

wherein the head unit jets the liquid from the plurality of nozzles during the moving of the carriage; and wherein the landing position correction mechanism corrects the landing position by adjusting a moving speed of the carriage.

13. The liquid jetting apparatus according to claim 1, further comprising:

a temperature detection mechanism configured to detect a temperature of the head unit directly or indirectly; and a carriage configured to carry the head unit thereon and to move reciprocatingly in a scanning direction intersecting the nozzle array direction;

wherein the head unit jets the liquid from the plurality of nozzles during the moving of the carriage; and wherein the carriage reverses its moving direction at a further outside position in the scanning direction for a higher temperature detected by the temperature detection mechanism.

14. The liquid jetting apparatus according to claim 1;

wherein the restriction mechanism restricts the head unit by sandwiching the head unit from the nozzle array direction.

15. The liquid jetting apparatus according to claim 14;

wherein a pair of notches are formed in both end portions of the head unit with respect to the nozzle array direction; and wherein the restriction mechanism includes a pair of sandwiching members fixed on a fixation portion provided outside of the head unit while engaging the pair of notches so that the pair of sandwiching members sandwich a portion of the head unit positioned between the pair of notches from the nozzle array direction.

16. The liquid jetting apparatus according to claim 15;

wherein one of the pair of sandwiching members is an eccentric cam supported to be rotatable about a shaft perpendicular to nozzle surfaces in which the plurality of nozzles are formed.

* * * * *